United States Patent [19]

Sakamoto

[11] 4,262,354

[45] Apr. 14, 1981

[54] TIME SETTING MECHANISM

[75] Inventor: Kazuo Sakamoto, Tanashi, Japan

[73] Assignee: Citizens Watch Co. Ltd., Tokyo, Japan

[21] Appl. No.: 33,784

[22] Filed: Apr. 27, 1979

[30] Foreign Application Priority Data

May 4, 1978 [JP] Japan ..... 53-053349

[51] Int. Cl.[3] ..... G04B 17/12; G04B 27/00; G04B 27/02; G04B 27/04

[52] U.S. Cl. ..... 368/185; 368/190; 368/192

[58] Field of Search ..... 58/85.5, 34, 36; 368/185, 190–199

[56] References Cited

U.S. PATENT DOCUMENTS

| | | | |
|---|---|---|---|
| 3,470,687 | 10/1969 | Ono et al. | 58/58 |
| 3,470,688 | 10/1969 | Miyasaka | 58/58 |
| 3,626,689 | 12/1971 | Vuilleumier | 58/85.5 |
| 3,702,530 | 11/1972 | Besson et al. | 58/85.5 |
| 3,813,873 | 6/1974 | Nakagawa | 58/85.5 |
| 3,987,618 | 10/1976 | Barth | 58/85.5 |

*Primary Examiner*—J. V. Truhe
*Assistant Examiner*—John B. Conklin
*Attorney, Agent, or Firm*—Jordan and Hamburg

[57] ABSTRACT

A time setting mechanism for a wristwatch having wheel train and time indicating hands driven by the wheel train, wherein first and second gear means are coaxially rotatable independently of one another, with the first gear means being drivably connected to a control stem and the second gear means being drivably connected to the wheel train. A shift gear is movable to engaging and disengaging positions by the action of a change-over means actuated by the control stem, to provide and interrupt drive connection between the first and second gear means.

12 Claims, 11 Drawing Figures

TIME SETTING MECHANISM

This invention relates to wristwatches having time indicating hands, and more particularly to a time setting mechanism for such wristwatches.

There are known in the art a variety of change-over levers that are used to correct time indicating hands of wristwatches, one example of which is shown in FIG. 1. In a correction mechanism of the type employing change-over lever 10 and a gear wheel 18 for transmitting the rotation of a winding stem 14 often experience back-lash. When the winding stem 14 is pulled out and/or depressed under such a condition a minutes wheel 16 is unintentionally caused to rotate because a shift gear wheel 12 shifted by the pivoting of the change-over lever 10 does so while undergoing rotation. This is particularly true when depressing the winding stem 14 and is a major defect in the prior art since it causes the hands of the wristwatch to shift and thus indicate the incorrect time.

It is therefore an object of the present invention to provide a time setting mechanism for a wristwatch in which time indicating hands do not experience the above mentioned shift during operation of a time setting stem.

It is another object of the present invention to provide a time setting mechanism which makes it possible to remarkably reduce the thickness of a wristwatch.

These and other objects, features and advantages of the present invention will become more apparent from the following description when taken in conjunction with the accompanying drawings, in which.

Figure 1:
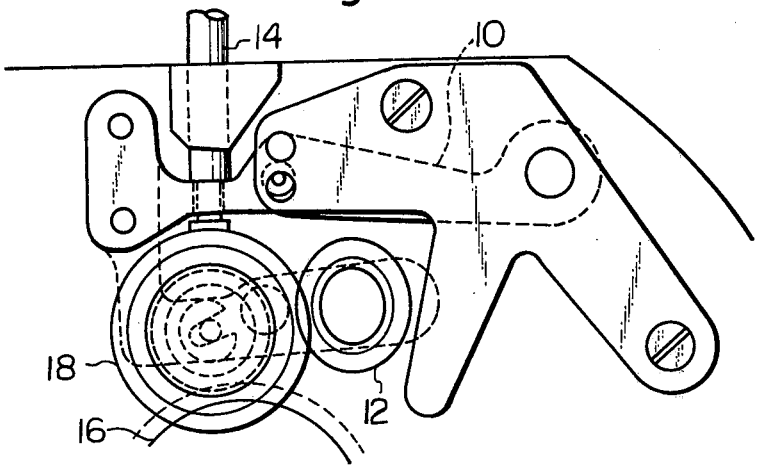
Fig. 1 PRIOR ART
FIG. 1 is a partial plan view of a prior art time setting mechanism for a wristwatch.
Figure 2A:
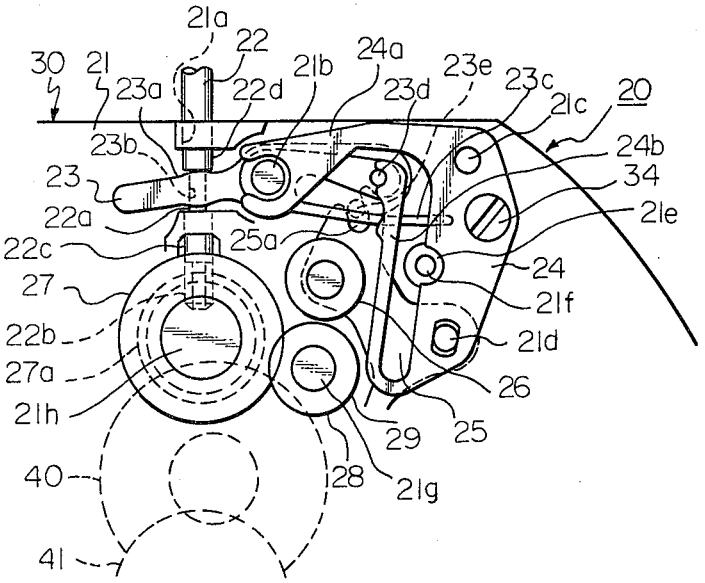
FIGS. 2A and 2B are partial plan views of a preferred embodiment of a time setting mechanism for a wristwatch according to the present invention.
Figure 2B:
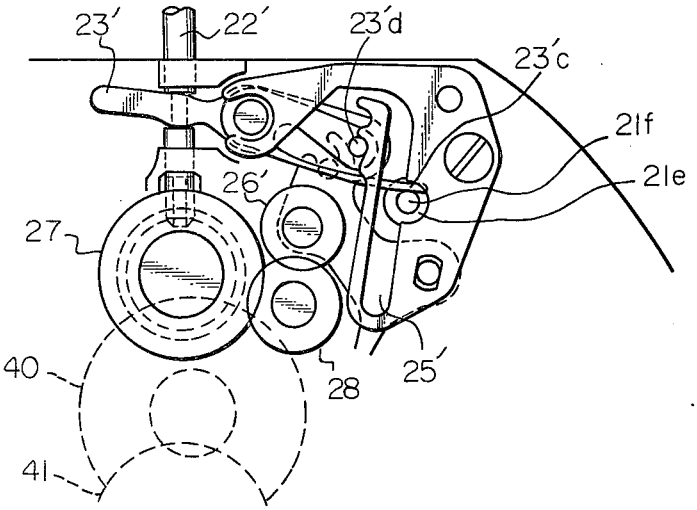
Figure 3:
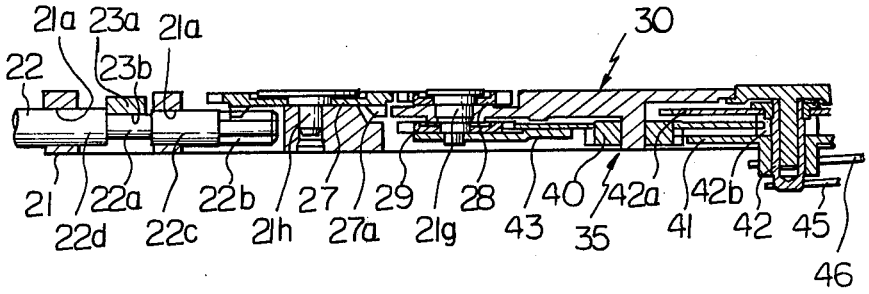
FIG. 3 is a cross sectional view of the time setting mechanism shown in FIGS. 2A and 2B.
Figure 4:
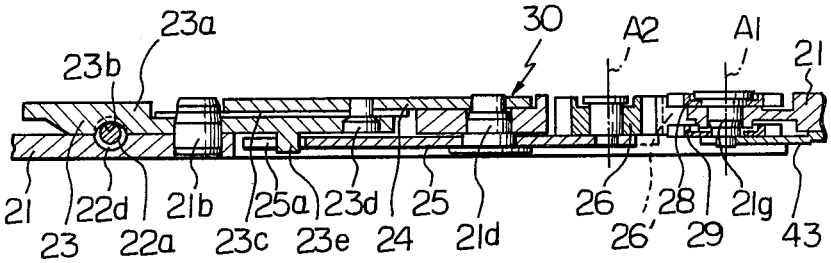
FIG. 4 is another cross sectional view of the time setting mechanism shown in FIGS. 2A and 2B.

FIGS. 2A and 2B, 3 and 4 show a preferred embodiment of a time setting mechanism for a wristwatch according to the present invention. In this preferred embodiment, the time setting mechanism, which is generally indicated at 20, comprises a control stem or time setting stem 22 which radially extends relative to the movement 30 of the wristwatch. The control stem 22 carries at its end a pinion gear **22*b* serving as a setting gear. The pinion gear 22*b* is in mesh with a toothed portion 27*a* of a setting gear wheel 27. The control stem 22 is radially movable to an operative or time setting position and an inoperative or non-time setting position. This control stem has axially spaced large diameter portions 22*c* and 22*d* slightly larger than the pinion gear 22*b* and loosely fitted into a radially extending bore 21*a* of a base plate 21. The control stem 22 also has a small diameter portion 22*a* formed between the large diameter portions 22*c* and 22*d*. A setting lever 23 is pivotable about a pivot shaft 21*b* upstanding from the base plate 21 as shown in FIGS. 2 and 4 and forms a part of a change-over means as will be described later. The setting lever 23 has a neck portion 23*a* formed at its lower surface with a recess 23*b* with which the small diameter portion 22*a* of the control stem 22 engages. The setting lever 23 also has at its one end a setting lever pin 23*d*, a downwardly extending boss portion 23*e*, and a reset lever 23*c* freely mounted on the pivot shaft 21*b* and positioned by the setting lever pin 23*d*. The reset lever 23*c* is actuated together with the setting lever 23 and is adapted to make contact with a reset terminal 21*f* of an electronic circuit of the wristwatch at an operative position indicated at 23'*c* as shown in FIG. 2B, the reset terminal 21*f* being so located and mounted on the base plate 21 through an insulating bushing 21*e*. A setting lever spring 24 is mounted on base plate 21 and includes a first setting lever spring portion 24*a* for biasing the setting lever 23 toward the plate 21, and a second spring portion 24*b* for positioning or holding the setting lever 23 at one of a plurality of operating positions by recesses (two in the illustrated embodiment) that engage with the setting lever pin 23*d*. The setting lever spring 24 itself is positioned by a pin 21*c* and rivet 21*d* and is secured to the base plate 21 by a screw 34. A change-over lever 25 forms another part of the change-over means and has a recess 25*a* for engaging with the boss 23*e* of setting lever 23 and is pivotally attached to the bottom side of base plate 21 by the rivet 21*d*. A shift gear wheel 26 is mounted on the change-over lever 25. The setting gear wheel 27, which is rotatably mounted on base plate 21 by a rivet 21*h*, meshes with a first transmission gear wheel 28 mounted on the base plate 21 by a shaft 21*g* and rotatable on a first axis A1 as shown in FIG. 4. A second transmission gear wheel 29 is also rotatably mounted on the shaft 21*g* fixedly supported by base plate 21 but on the bottom side of the base plate 21. The second transmission gear wheel 29 meshes with a minutes wheel 40 of a gear wheel train 35 of the wristwatch. The minutes wheel 40 cooperates with a minute wheel spring 43 to retain the transmission gear wheel 29 and prevent it from falling off. The minutes wheel 40 meshes with an hours wheel 41 and a center wheel and pinion 42, and a slip mechanism is provided between the center wheel pinion 42*a* and cannon pinion 42*b* of the center wheel and pinion 42**.

Referring now to FIGS. 2A and 2B, FIG. 2A shows the state in which the control stem 22 is in the depressed or non-time setting position while FIG. 2B shows the state in which the control stem 22 is in the depressed or non-time setting position. First, with the wristwatch in its normally operating state and the control stem 22 depressed, a drive power is transmitted from an electromechanical transducer (not shown) to the minutes wheel 40 and hence to the second transmission gear wheel 29, whereas rotation of the control stem 22 under these conditions can be transmitted only as far as the setting gear wheel 27 and the first transmission gear wheel 28 so that the two rotation transmission paths are isolated from one another. If the control stem 22 is now pulled out, i.e., to a time setting position, the setting lever 23 will pivot to the new position 23' until the setting lever pin **23*d* is repositioned at 23'*d* by the spring portion 24*b* of setting lever spring 24. The control stem 22 is therefore positioned at 22' and the change-over lever 25 at 25' so that the shift gear wheel 26 is shifted to an engaging position 26' relative to the first axis A1 by the action of the change-over means 23 constituted by the setting lever and thus made to mesh with the first transmission gear wheel 28. The reset lever 23c mounted on setting lever 23 is shifted to position 23'c and makes contact with the reset terminal 21f to reset the associated electronic circuitry. Although not shown in FIGS. 2A to 4 a brake lever to be actuated by the change-over lever 25 is provided to provide a braking effect. If the control stem 22 in the position 22' is now rotated under these conditions the turning effort or torque can be transmitted from minutes wheel 40 to hours wheel 41 and to the center wheel and pinion 42 because the shift gear wheel 26 in the position 26' meshes with the first and second transmission gear wheels 28 and 29. Meanwhile the angle through which the center wheel 42b rotates is restricted by the brake lever described above with the torque resulting from rotation of the control stem 22 in position 22' causing slipping between the center wheel pinion 42a and cannon pinion 42b thereby allowing the hands 45, 46 of the wristwatch to be set. If the control stem 22 is now depressed to return it from position 22' to its original position, setting lever 23 returns to its original position from 23', change-over lever 25 to its original position from 25', and shift gear wheel 26 to its original position from 26'. Since change-over lever 25 actuates the brake lever only when in the position 25', returning the change-over lever 25 to its original position releases the brake. The reset lever 23c is similarly returned to its original position by the setting lever 23 and is therefor removed from the reset terminal 21f** to restore the wristwatch circuitry to its normal operation.

In accordance with the embodiment mentioned above, the operation of the shift gear wheel 26 mounted on the change-over lever 25 is such that disengaging the shift gear wheel 26 from the first transmission gear wheel 28 leaves this gear wheel free of any externally applied torque since it is no longer meshing with a member capable of applying such a torque. The hands 45 and 46 of the wristwatch are therefore not shifted when depressing the control stem 22 at the end of a time correction.

Figure 5:
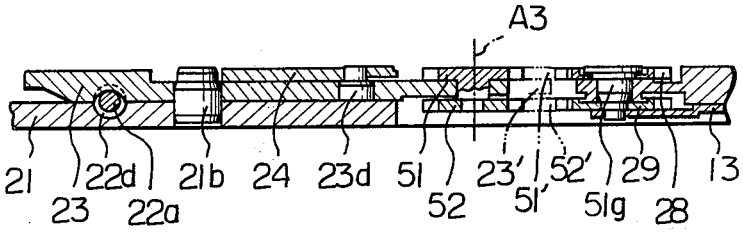
FIG. 5 is a cross sectional view of another preferred embodiment of the time setting mechanism according to the present invention.

FIG. 5 is a cross-sectional view of another preferred embodiment of the present invention, with like or corresponding component parts bearing the same reference numerals as those used in FIGS. 2A through 4 and operating in an identical manner. In this embodiment a first shift gear wheel 51 and second shift gear wheel 52 are supported by setting lever 23 and rotatable on the same axis A3. The setting lever 23 is thus capable of serving as a change-over means. More specifically, when the control stem 22 is in the depressed position the first and second transmission gear wheels 28 and 29 are drivably isolated from one another as in the first embodiment. Next, pulling out the control stem 22 moves the setting lever 23 to the position 23' so that the first shift gear wheel 51 moves to the position 51' and meshes with the first transmission gear wheel 28 while the second shift gear wheel 52 moves to the position 52' and meshes with the second transmission gear wheel 29. Under these circumstances the reset lever and brake lever operate in the same manner as the first embodiment. If the control stem 22 is now rotated the first and second transmission gear wheels 28 and 29 are drivably connected to one another by the first and second shift gear wheels 51 and 52 which rotate in unison as a single gear in the positions 51' and 52'. The hands of the wristwatch are therefore corrected in the same manner as the first embodiment.

Figure 6:
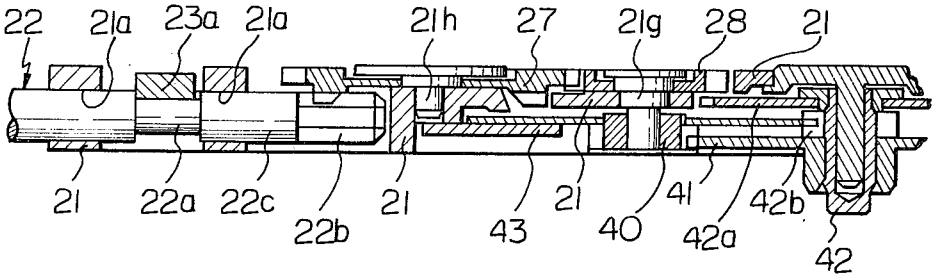
FIGS. 6 and 7 are cross sectional views of another preferred embodiment of a time setting mechanism according to the present invention.
Figure 7:
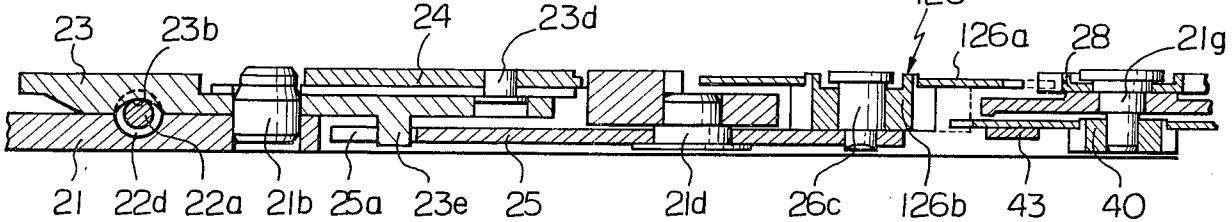

FIGS. 6 and 7 show another preferred embodiment of a time setting mechanism according to the present invention, with like or corresponding component parts bearing the same reference numerals as those used in FIGS. 2–4. In this preferred embodiment, the second transmission gear wheel 29 is replaced with a minutes wheel 40, which is rotatably supported by the pivot shaft 21g supported by the base plate 21. The minutes wheel 40 is freely rotatably independently of the transmission gear wheel 28 and no drive connection is provided between the transmission gear wheel 28 and the minutes wheel 40 in the non-time setting state of the time setting mechanism. A shift gear wheel 126 is rotatably supported by the change-over lever 25 and comprises a first gear 126a and a second gear 126b rotatable on the same axis as the first gear 126a. As shown in FIG. 7, the shift gear wheel 126 is normally held in its inoperative position, i.e., when the control stem 22 remains in its depressed condition. Under these circumstances, the drive power is not transmitted to the minutes wheel 40 from the control stem 22 even when the control stem 22 is rotated, because the first and second gears 126a and 126b of the shift gear wheel 126 are out of engagement with the transmission gear wheel 28 and the minutes wheel 40, respectively. When the control stem 22 is pulled out to the time setting position, the change-over lever 25 of the change-over means is rotated about the pivot shaft 21d by means of boss portion 23e of the setting lever 23, and the shift gear wheel 126 is moved to its operative position. Under this condition, the first gear 126a meshes with the transmission wheel 28 and the second gear 126b meshes with the minutes wheel 40. Under these circumstances, if the control stem 22 is rotated, the pinion gear 22b of the control stem 22 rotates the setting gear wheel 27, which in turn rotates the transmission gear wheel 28. Since, in this condition, the transmission gear wheel 28 is held in engagement with the first gear 126a of the shift gear wheel 126 and at the same time the second gear 126b is in mesh with the minutes wheel 40, the rotation of the transmission gear wheel 28 is transmitted to the minutes wheel 40 by which the hands of the wristwatch is corrected. Other parts of the time setting mechanism of FIGS. 6 and 7 are identical to those of FIGS. 2A–4 and, accordingly, a detailed description of the same is herein omitted.

Figure 8:
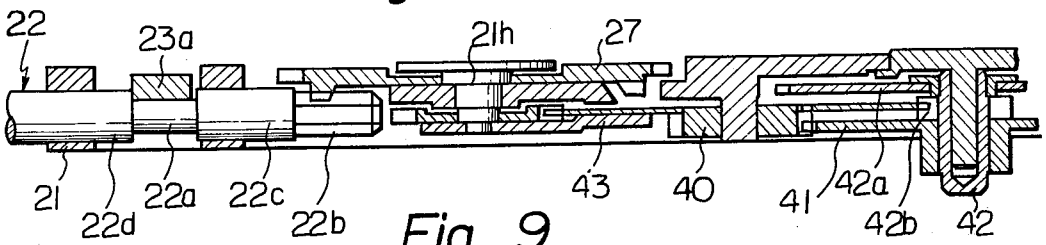
FIGS. 8 and 9 are cross sectional views illustrating another preferred embodiment of a time setting mechanism according to the present invention.
Figure 9:
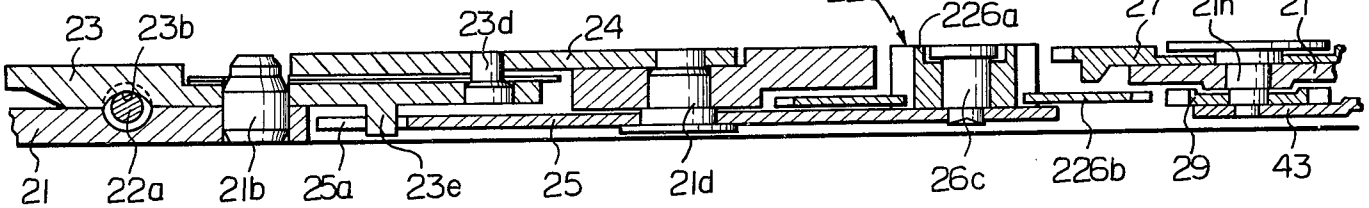

FIGS. 8 and 9 illustrate another preferred embodiment of the time setting mechanism according to the present invention, with like parts bearing the same reference numerals as those used in FIGS. 2A–4. In this illustrated embodiment, the second transmission gear wheel 29 is rotatably supported by the pivot shaft 21h by which the setting gear wheel 27 is also rotatably supported. The transmission gear wheel 29 is rotatable independently of the setting gear wheel (see FIGS. 9) and is in mesh with the minutes wheel 40 (see FIG. 8). A shift gear wheel 226 is rotatably supported by a pivot shaft 26c secured to the changeover lever 25. The shift gear wheel 226 comprises a first gear 226a engageable with the setting wheel 27, and a second gear 226b engageable with the transmission gear wheel 29. With this arrangement, when the control stem 22 remains in its inoperative position, i.e., depressed position, the changeover lever 25 maintains the shift gear wheel 226 in its inoperative position shown in FIG. 9. Under this condition, if the control stem 22 is rotated, the setting gear wheel 27 rotates about the pivot shaft 21*h*. Since, in this condition, the setting gear wheel 27 is not drivably connected to the transmission gear wheel 29, no rotation is transmitted to the minutes wheel 40. When, in contrast, the control stem 22 is pulled out, the setting lever 23 is moved so that the boss portion 23*e* of the setting lever 23 will move the change-over lever 25 to its operative position. In this case, the first gear 226*a* of the shift gear wheel 226 is brought into engagement with the setting gear wheel 27 and at the same time the second gear 226*b* of the shift gear wheel 226 is brought into engagement with the transmission gear wheel 29. Thus, the setting gear wheel 27 is drivably connected to the transmission gear wheel 29. Accordingly, if the control stem 22 is rotated under these conditions, the setting wheel 27 will rotate the transmission gear wheel 29 by means of the shift gear wheel 226. Since, the transmission gear wheel 29 is in mesh with the minutes wheel 40, the rotation of the control stem 22 will allow the correction of the time indicating hands.

Figure 10:
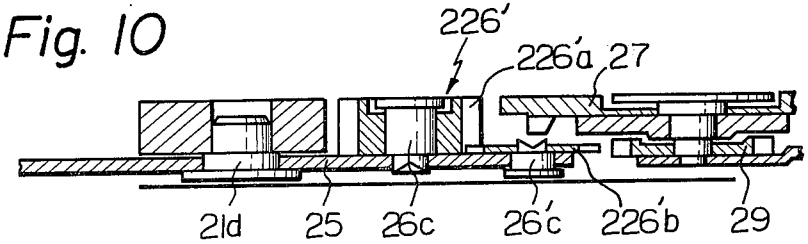
FIG. 10 is a cross sectional view of a modified form of the time setting mechanism shown in FIGS. 8 and 9.

FIG. 10 shows a modification of the time setting mechanism shown in FIGS. 8 and 9. The modification of FIG. 10 is identical in structure to the embodiment of FIGS. 8 and 9 except that the shift gear wheel 226' comprises a first gear 226'*a* rotatable on the pivot shaft 26*c* and a second gear 226'*b* rotatably supported by another pivot shaft 26'*c* carried by the changeover lever 25. The second gear 226'*b* is in mesh with the first gear 226'*a* and engageable with the transmission gear wheel 29 when the changeover lever 25 is moved to its operative position by the action of the setting lever (not shown). On the other hand, the first gear 226'*a* is engageable with the setting gear wheel 27 when the second gear 226'*b* engages with the transmission gear wheel 29. The time setting mechanism thus arranged will operate in the same manner as that of FIGS. 8 and 9, and, therefore, detained description of the same is herein omitted.

While it is obvious that the time indicating hands of the wristwatch in the embodiments discussed above are not shifted or disturbed when the control stem remains in its depressed condition, another advantage of the present invention is that the setting gear wheel is attached to the base plate by means of the rivet and therefore the undesirable movement of the setting gear wheel is prevented. In the prior art the setting gear wheel is rotatably mounted on the change-over lever and is therefore not disposed in a stable manner. This tends to allow the pinion gear of the control stem to disengage from the setting gear wheel. The structure of the present invention, however, precludes such disengagement and is particularly effective when applied to an extremely slender wristwatch construction where there is only a small meshing interface between the pinion gear of the control stem and the setting gear wheel. It is also obvious that the present invention can be applied to mechanical as well as electronic wristwatches.

What is claimed is:

1. A time setting mechanism for a wristwatch having time indicating hands, and a wheel train drivably connected to said time indicating hands for actuating said time indicating hands, comprising:

a control stem including a setting gear and movable to time setting and non-time setting positions;

first gear means drivably connected to the setting gear of said control stem and rotatable on a first axis;

second gear means rotatable on said first axis independently of said first gear means and drivably connected to said wheel train;

change-over means actuated by said control stem to assume first and second positions when said control stem is moved to said time setting and non-time setting positions, respectively; and shift gear means carried by said change-over means and rotatable on a second axis distanced from said first axis, said change-over means moving said shift gear means to engaging and disengaging positions relative to said first axis;

whereby when said shift gear means is moved to said engaging position said shift gear means is brought into engagement with said first and second gear means to drivably connect said control stem to said wheel train to allow adjustment of said time indicating hands whereas when said shift gear means is moved to said disengaging position said shift gear means is brought out of engagement with said first and second gear means to interrupt drive connection between said control stem and said wheel train.

2. A time setting mechanism according to claim 1, further comprising a setting gear wheel meshing with said setting gear of said control stem and also meshing with said first gear means.

3. A time setting mechanism according to claim 1 or 2, in which each of said first and second gear means comprises a transmission gear wheel.

4. A time setting mechanism according to claim 1, in which said change-over means comprises a setting lever cooperating with said control stem and actuated thereby, and a change-over lever rotatably supporting said shift gear means and cooperating with said setting lever to be movable to said first and second positions.

5. A time setting mechanism according to claim 1, in which said shift gear means comprises a single gear which is engageable with both of said first and second gear means when said change-over means assumes said first positions.

6. A time setting mechanism according to claim 1, in which said shift gear means comprises first and second gears which are engageable with said first and second gear means, respectively, when said change-over means assumes said first positions.

7. A time setting mechanism according to claim 2, in which said first gear means comprises a transmission gear wheel drivably connected to said control stem and in which said second gear means comprises a minutes wheel forming part of said wheel train, said minutes wheel being rotatable on the same axis with said transmission gear wheel independently of said transmission gear wheel.

8. A time setting mechanism according to claim 7, in which said shift gear means comprises first and second gears engageable with said transmission gear wheel and said minutes wheel, respectively, when said change-over means assumes said first position.

9. A time setting mechanism according to claim 1, in which said first and second gear means comprise a setting gear wheel and a transmission gear wheel, said setting gear wheel meshing with the setting gear of said control stem, and said transmission gear wheel being rotatable on the same axis with said setting gear wheel independently thereof and meshing with said wheel train.

10. A time setting mechanism according to claim 9, in which said shift gear means comprises first and second gears engageable with said setting gear wheel and said transmission gear wheel, respectively, when said change-over means assumes said first position.

11. A time setting mechanism according to claim 9, in which said first and second gears of said shift gear means are coaxially rotatable and interconnected to one another.

12. A time setting mechanism according to claim 10, in which said first and second gears of said shift gear means are rotatable on different axes and said first gear meshes with said second gear.

* * * * *